United States Patent [19]

Kuo et al.

[11] 4,033,837

[45] July 5, 1977

[54] PLATED METALLIC CATHODE

[75] Inventors: Han C. Kuo; Ronald L. Dotson; Kenneth E. Woodard, Jr., all of Cleveland, Tenn.

[73] Assignee: Olin Corporation, New Haven, Conn.

[22] Filed: Feb. 24, 1976

[21] Appl. No.: 660,847

[52] U.S. Cl. ..... 204/98; 204/43 T; 204/290 R; 204/293

[51] Int. Cl.[2] ..... C25B 1/34; C25B 11/04

[58] Field of Search ..... 204/43 T, 290 R, 290 F, 204/293, 98, 129

[56] References Cited

UNITED STATES PATENTS

| | | | |
|---|---|---|---|
| 2,755,241 | 7/1956 | Bagley et al. | 204/105 M |
| 3,291,714 | 12/1966 | Hall et al. | 204/256 |
| 3,380,908 | 4/1968 | Ono et al. | 204/290 F |
| 3,441,495 | 4/1969 | Colman | 204/268 |
| 3,947,331 | 3/1976 | Kinh et al. | 204/37 R |

*Primary Examiner*—F.C. Edmundson
*Attorney, Agent, or Firm*—James B. Haglind; Thomas P. O'Day; Donald F. Clements

[57] ABSTRACT

A highly conductive and corrosion resistant low hydrogen overvoltage cathode. The cathode comprises a copper substrate plated with an alloy of nickel, vanadium, and molybdenum.

6 Claims, 2 Drawing Figures

PLATED METALLIC CATHODE

This invention relates generally to a cathode for an electrolytic cell, and more particularly, to a plated metallic cathode for use in such cells.

One of the largest costs in the operation of electrolytic cells is that of electrical energy. Consequently, efforts have been made to reduce the working voltage of the cell. One of the components contributing to the working voltage is the overvoltage at the cathode. In the case of a cell used for the electrolysis of alkali metal chloride solutions, for example, this componenet is referred to as hydrogen overvoltage.

Previously, cathodes have been constructed of various metals such as low-carbon steel, titanium, nickel, chromium, copper, iron, tantalum, and the like, and alloys thereof, especially stainless steel and other chromium steels, nickel steels, and the like. For a given structural configuration, current density, temperature, and electrolyte, each of these metals when used as a cathode will possess a given over-voltage.

In an article published in *Zeszyty Naukowe Politechniki Slaskief*, Chemia No. 65, pp. 235 and 236, 1975 (Poland), by Andrzej Malachowski, there is disclosed an electrode having a reduced hydrogen overvoltage. The electrode disclosed in the article comprised a steel substrate plated with a nickel, molybdenum, vanadium alloy. Although the Ni—Mo—V plated steel electrode does have a reduced overvoltage, it has been found to be prone to corrosion, even to the extent that the plating will peel off after a few weeks when the potential is removed.

It is an object of the present invention to provide an improved cathode which has a relatively low hydrogen overvoltage.

It is a further object of the present invention to provide an improved cathode having a relatively low hydrogen overvoltage and improved corrosion resistance.

The above objects may be accomplished, according to the preferred form of the invention, through the provision of a cathode comprising a copper substrate plated with an alloy of nickel, molybdenum, and vanadium.

Figure 1:
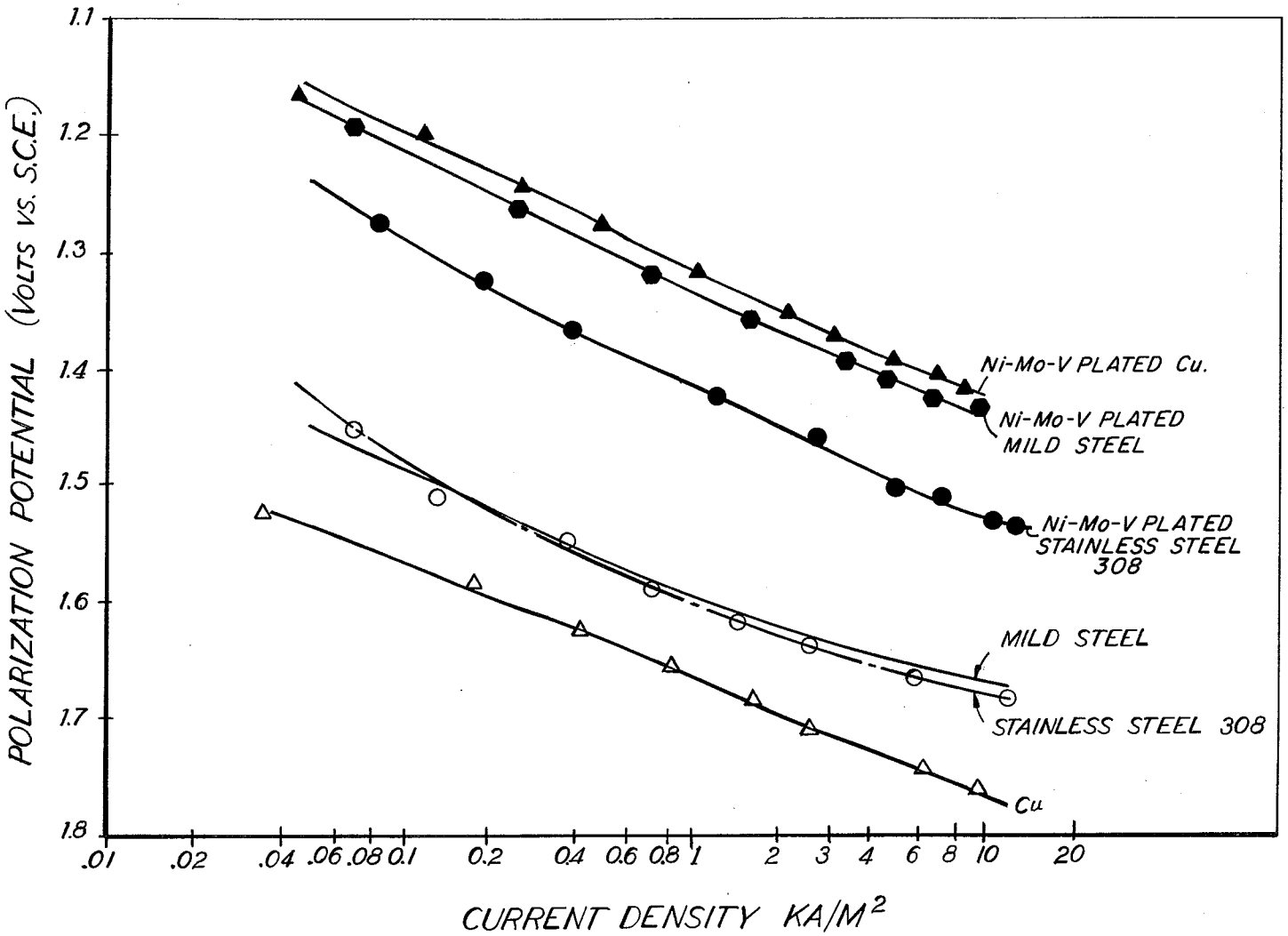
Figure 2:
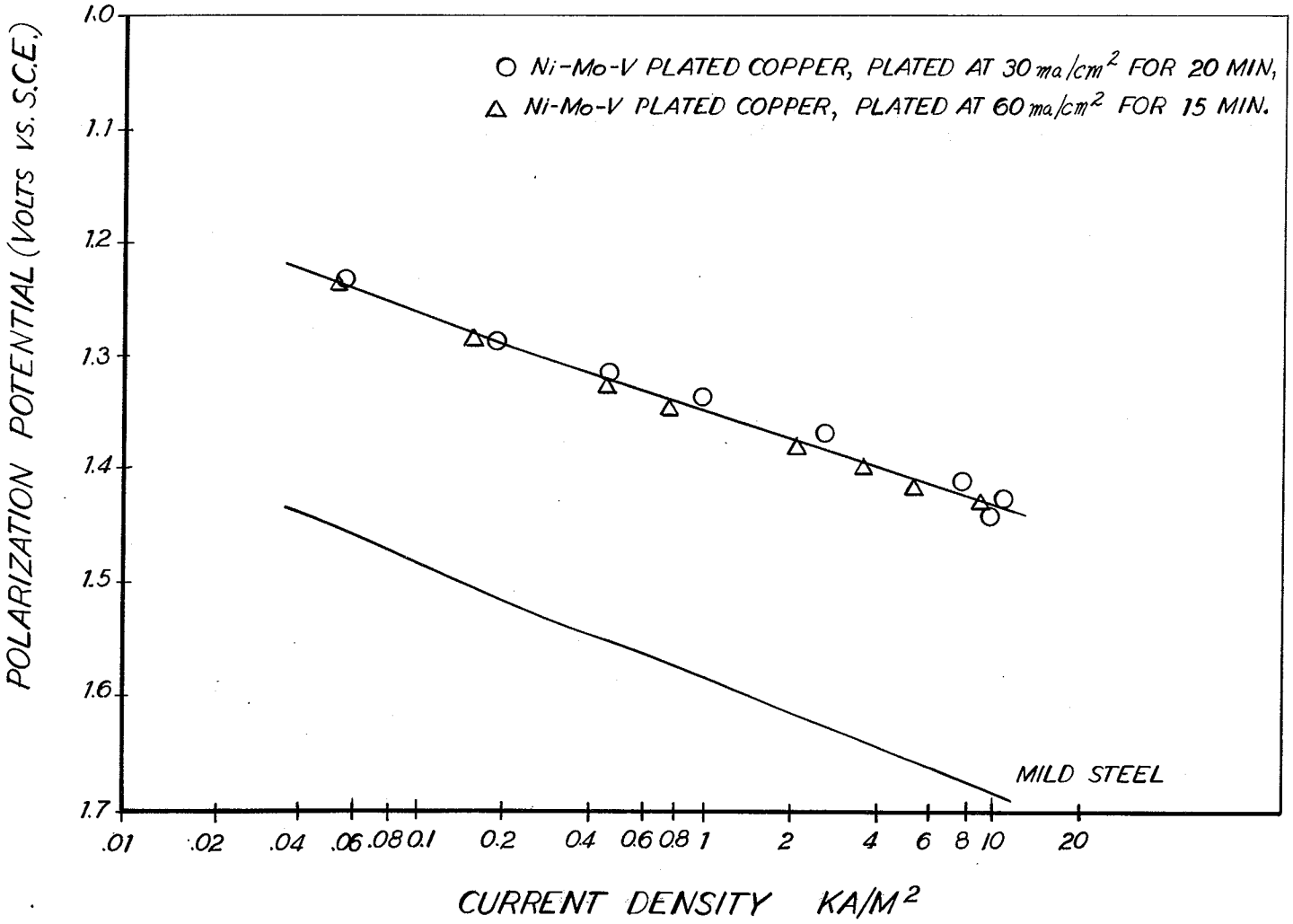

A better understanding of this invention may be had by reference to the following detailed description and to the accompanying drawing in which FIGS. 1 and 2 are graphs ploting the polarization potential against various current densities for various plated and unplated cathodes.

More specifically, it is contemplated that the cathode structure may be of any shape suitable for the intended purpose. For example, the cathode of the present invention may comprise a plate, a rod, a foraminous structure, or mesh of any shape well known in the art.

The cathode is fabricated from a copper substrate to which is applied a plating of an alloy of nickel, molybdenum and vanadium. The present by weight of the various alloys in the plating may be as follows: nickel, 80 to 90; vanadium, 0.2 to 1.5; and molybdenum, 10 to 20. The thickness of the plating may be in the order of 2 to 30 microns. Preferably, the thickness is in the order of about 20 to 25 microns.

The nickel, molybdenum, vanadium plating is preferably electrodeposited on the copper substrate using a Watt's bath with the addition of small amounts of a vanadium and molybdenum in a form that will provide a source of ions to be deposited by discharge in an aqueous solution. The bath may be an aqueous solution of nickel sulfate in the amount of 240 to 340 g/l (grams per liter), nickel chloride in the amount of 30 to 60 g/l, and boric acid in the amount of 20 to 40 g/l. The molybdenum and vanadium ion source may be sodium molybdate in the amount of 0.2 to 2.0 g/l and vanadium sulfate in the amount of 0.2 to 0.8 g/l. Other sources of the vanadium and molybdenum ion may be used.

Prior to immersing the copper substrate in the bath, the surface of the substrate should be cleaned. This can be accomplished by conventional techniques well known in the art for cleaning preparatory to nickel plating. For example, the copper substrate may be etched in a solution containing 10 to 40% volume parts sulfuric acid having a concentration of 97% $H_2SO_4$ by weight, and 5 to 20 volume parts nitric acid having a concentration of 71% $HNO_3$ by weight and 40 to 85 volume parts water for about 5 to 15 minutes at room temperature. Alternatively, it may be cathodically cleaned in a caustic solution of 10 to 20 weight parts sodium hydroxide and 80 to 90 weight parts water at room temperature at 20 to 80 ma/cm$^2$ for about 5 to 10 minutes. After either of the above operations, the copper substrate should be rinsed with deionized water. Prior to immersing the copper substrate into the plating bath, it may be immersed in a solution of about 10 volume parts sulfuric acid having a concentration of 97% $H_2SO_4$ by weight, about 10 volume parts hydrochloric acid having a concentration of 37% HCl by weight, and about 80 volume parts water, room temperature, for 10 to 40 seconds and then rinsed with deionized water.

After cleaning, the copper cathode structure may be immersed in the above described plating bath. The bath may have a pH of 3.5 to 5.5 and be at a temperature of 20° to 45° C. The plating current density may be 20 to 80 ma/cm$^2$. The plating operation may continue for 15 to 30 minutes or until a suitable layer of alloy material has been deposited.

The resulting product is a cathode having a copper substrate with a plating of about 80 to 90% by weight nickel, about 0.2 to 1.5% by weight vanadium, and about 10 to 20% by weight molybdenum.

The cathodes of the present invention show lower hydrogen overvoltages at various current densities as compared with bare copper, bare mild steel, and bare stainless steel 308. In addition, the plated copper cathode of the present invention shows improved corrosion resistant properties as compared to a mild steel plated with the same alloy.

The cathode of this invention is particularly useful in chlor-alkali electrolytic cells. However, it is contemplated that it may also be used in the electrolysis of water.

The following examples are presented to better define the invention without any intention of being limited thereby. All parts and percentages are by volume at room temperature unless otherwise indicated.

EXAMPLE I

A ⅛ inch diameter copper rod was etched for 10 minutes in a mixture of 20 volume parts of analytical grade sulfuric acid having a concentration of 97% $H_2SO_4$ by weight, 5 volume parts of analytical grade nitric acid having a concentration of 71% $HNO_3$ by weight, and 75 volume parts water. After etching, the copper rod was rinsed in deionized water. Prior to immersing in the plating bath, the copper rod was dippped in a solution of 10 volume parts of analytical grade sulfuric acid having a concentration of 97% $H_2SO_4$ by weight, 10 volume parts of analytical grade hydrochloric acid having a concentration of 37% HCl by weight for about 30 seconds. After dipping, the copper rod was rinsed in dionized water. The copper rod was placed in a plating bath comprising 300 g/l nickel sufate, 60 g/l nickel chloride, 20 g/l boric acid, 0.6 g/l sodium molybdate, and 0.4 g/l vanadium sulfate. The bath was run at 25° ± 2° C. at a current density of 30 ma/cm² for 10 minutes and at 60 ma/cm² for an additional 10 minutes.

A ¼ inch diameter steel rod and a ¼ inch diameter stainless steel rod were etched in a solution of 10 volume parts analytical grade sulfuric acid having a concentration of 97% $H_2SO_4$ by weight and 90 volume parts water for 10 minutes. After rinsing with deionized water, the two steel rods were anodically cleaned in a caustic solution of 10 volume parts sodium hydroxide and 90 parts water for 5 minutes at 50 ma/cm² (milliamps per square centimeter) after which they were washed in deionized water. Prior to immersion on the plating bath, the rods were dipped in a solution of 10 volume parts of analytical grade sulfuric acid having a concentration of 97% $H_2SO_4$ by weight and 90 volume parts water about 30 seconds. The steel rods were then placed in the bath and plated as described above in connection with the copper rod.

Each of the plated rods were operated as a cathode with varying current densities in a solution of 13 weight parts NaOH, 15 weight parts NaCl, and 72 weight parts water at 25° C. and the polarization potential determined for various current densities using a saturated calomel electrode. A similar procedure was used to determine the polarization potential of ¼ inch diameter bare copper, bare mild steel, and bare stainless steel rods in the same solution.

The results of various readings of the rods are plotted on the graph of FIG. 1, which shows the polarization potential in volts versus a saturated calomel electrode plotted along the ordinate in decreasing magnitude and the curren density in KA/M² (kiloamps per square meter) plotted along the abscissa in increasing magnitude. Thus the current at the upper portion of the graphs have a less negative polarization potential. The polarization potential gives a direct indication of relative overvoltage as overvoltage is equal to polarization potential minus the reversible potential.

As the graph of FIG. 1 shows, the polarization potential and thus the overvoltage, of the Ni—Mo—V plated copper rod cathode is slightly lower than that of the mild steel rod plated with the same alloy and on the order of 100 mv lower than that of the same alloy plated on stainless steel 308 rod. Also, the polarization potential of the plated copper rod cathode is on the order of about 280 mv lower than that of a rod of bare mild steel with an even greater reduction is shown with respect to a rod of bare copper.

EXAMPLE II

Two ¼ inch diameter copper rods, which had been etched, rinsed, and dipped as set forth in Example I were plated in a bath of the same composition and temperature as set forth in Example I. One rod was plated for 20 minutes at 30 ma/cm² and the other for 15 minutes at 60 ma/cm². Both rods were used as a cathode at various current densities in a 36% by weight caustic solution at 25° C. and the polarization potential was determined using a saturated calomel electrode. An unplated mild steel ¼ inch diameter rod was also tested in the same solution.

The results of various readings were plotted on the graph of FIG. 2 with the polarization potential in volts versus a saturated calomel electrode plotted along the ordinate in decreasing magnitude and current density in KA/M² plotted along the abscissa in increasing magnitude. The polarization potential and thus the hydrogen over-voltage of the two plated copper rods is about the same and about 220 mv lower than that of bare mild steel.

EXAMPLE III

Several Ni—Mo—V plated copper and mild steel rods of ¼ inch diameter were plated according to the procedures set forth in Examples I and II. The plated electrodes were put into a 25% brine solution having a pH=6 for an accelerated corrosion test without polarization. Within 3 to 5 days visible pits started to form on the plated steel surface and the coatings peeled off in many instances after two weeks immersion time. No visible corrosion was observed on the plated copper rods after 3 weeks and no coatings peeled off.

EXAMPLE IV

A ¼ inch diameter copper rod was plated with the Ni—Mo—V alloy according to the procedure set forth in Example I. The plated copper rod was operated in a small brine electrolytic cell as a cathode at 4KA/m² for about 5 weeks, During that time, no visible corrosion was observed and the hydrogen overvoltage did not change.

As indicated by the polarization potential, the hydrogen overvoltage of the Ni—Mo—V plated copper cathode is substantially lower than that of bare copper, bare mild steel, and bare stainless steel. Although in some cases, the overvoltage of Ni—Mo—V plated mild steel compared favorably with that of similarly plated copper, the plated copper cathode exhibited better corrosion resistant properties.

The use of the highly conductive copper substrate in constructing the cathode will also minimize the voltage loss within the cathode compartment during cell operation.

What is claimed is:

1. A cathode for use in electrolytic cells comprising a copper substrate and a plating on said copper substrate, said plating being an alloy of nickel, vanadium, and molybdenum.

2. The cathode of claim 1 wherein said plating comprises about 80 to about 90% by weight nickel, about 0.2 to about 1.5% by weight vanadium, and about 10 to about 20% by weight molybdenum.

3. The cathode of claim 1 wherein said plating has a thickness of between about 2 and about 30 microns.

4. The cathode of claim 1 wherein said plating is applied to said cathode structure by electrodeposition using a bath comprising an aqueous solution of the following:

Nickel Sulfate: 240 to 340 g/l;
Nickel Chloride: 30 to 60 g/l;
Boric Acid: 20 to 40 g/l;
Sodium Molybdate: 0.20 to 2.0 g/l; and
Vanadium Sulfate: 0.20 to 0.80 g/l.

5. The cathode of claim 4 wherein said bath has a pH of about 3.5 to 5.5, a temperature of 20° C. to 45° C., and a current density of 20 to 80 ma/cm² is used.

6. The cathode of claim 1 used in electrolytic cells for the electrolysis of alkali metal chloride solutions.

* * * * *